United States Patent [19]

Thompson

[11] 4,138,963

[45] Feb. 13, 1979

[54] BOAT STEERING MECHANISM

[76] Inventor: William C. Thompson, P.O. Box 214, Goree, Tex. 76363

[21] Appl. No.: 845,621

[22] Filed: Oct. 26, 1977

[51] Int. Cl.[2] ..... B63H 11/10; B63H 11/04

[52] U.S. Cl. ..... 115/12 R; 60/222; 60/229; 114/151; 115/16

[58] Field of Search ..... 115/11, 12 R, 14, 15, 115/16, 39; 114/150, 151; 60/221, 222, 229; 239/265.25, 265.27, 265.29

[56] References Cited

U.S. PATENT DOCUMENTS

| | | | |
|---|---|---|---|
| 3,610,197 | 10/1971 | Sporri | 115/12 R |
| 4,044,704 | 8/1977 | Miller | 114/151 |

*Primary Examiner*—Charles E. Frankfort

*Attorney, Agent, or Firm*—Burns, Doane, Swecker & Mathis

[57] ABSTRACT

A boat includes a longitudinal water channel along the bottom thereof. A motor driven propeller in the channel circulates water from a forward inlet end thereof to a rear outlet end thereof to advance the boat through the water. Passages are provided which communicate with the channel and which are adapted to discharge water through front and rear openings on the port and starboard sides. Gates are provided for opening these passages. A gate actuating mechanism is provided for opening the front port and rear starboard passages to rotate the boat in one direction about its own vertical axis. Another gate actuating mechanism is provided for opening the front starboard and rear port passages to rotate the boat in the opposite direction about its own vertical axis. Upon being opened, each set of gates serves to block travel of water to the outlet of the channel, and thereby divert all water through the passages.

5 Claims, 10 Drawing Figures

Fig. 4
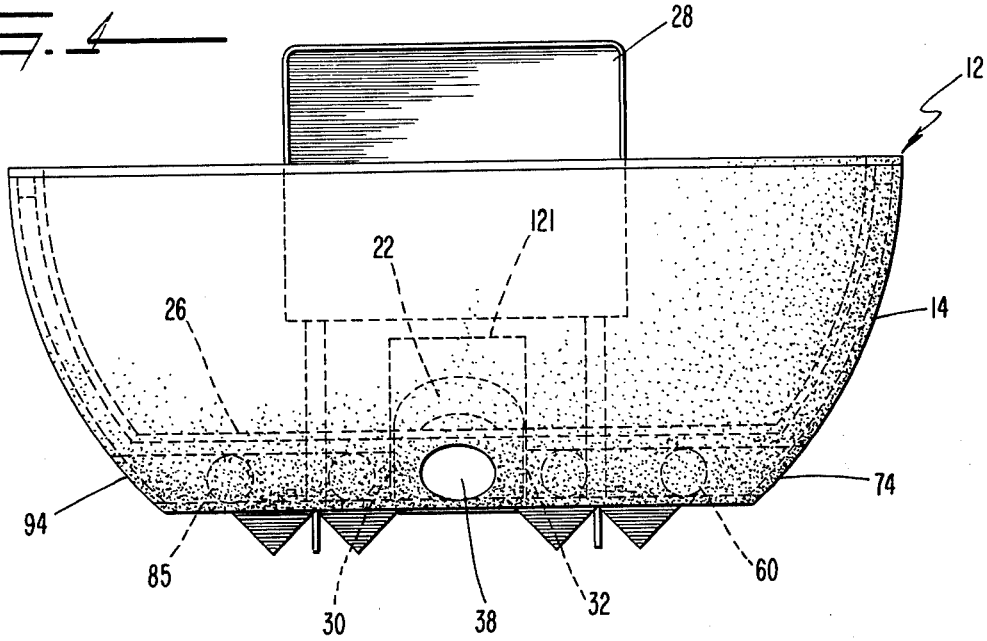
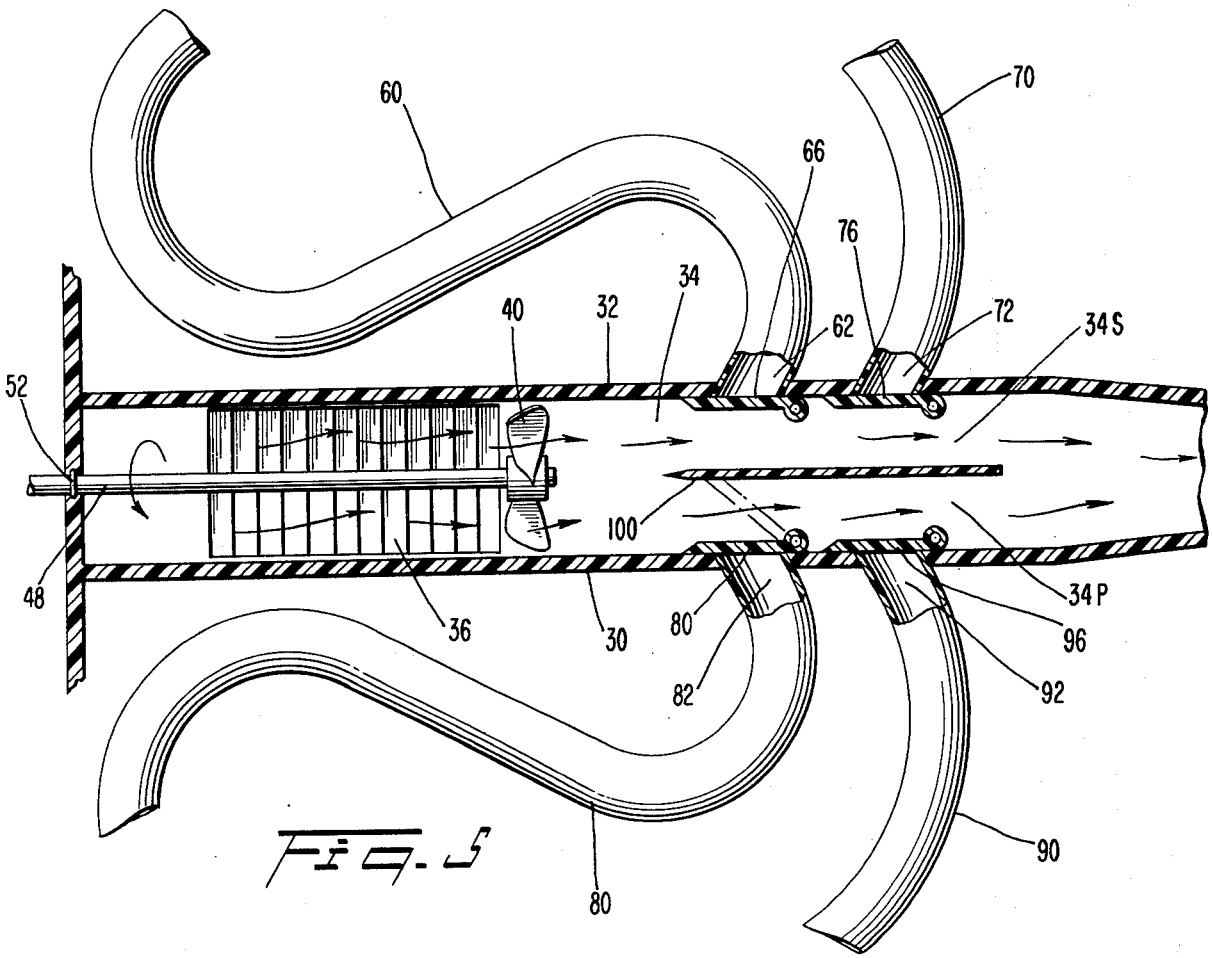
Fig. 5

Fig. 6
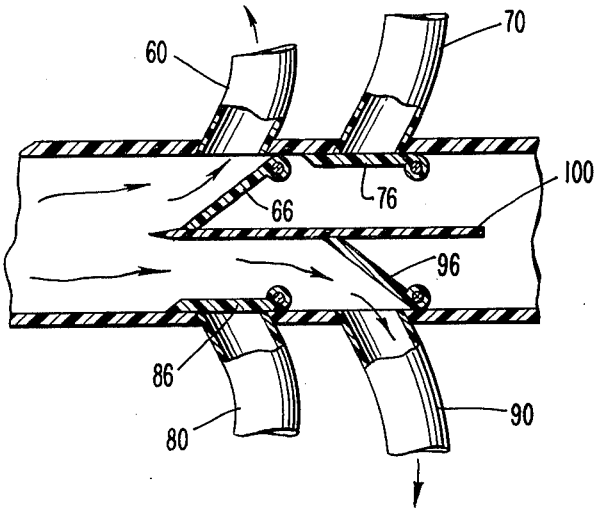
Fig. 7
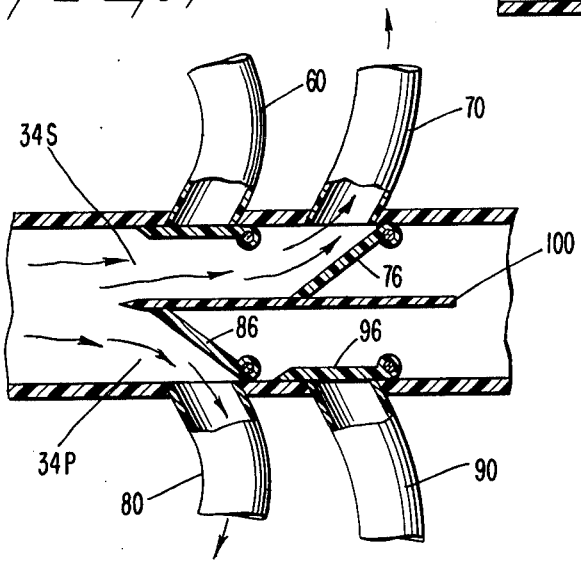
Fig. 8
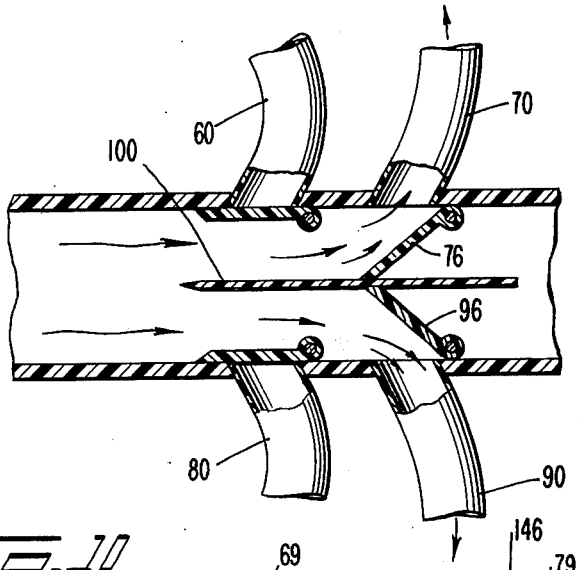
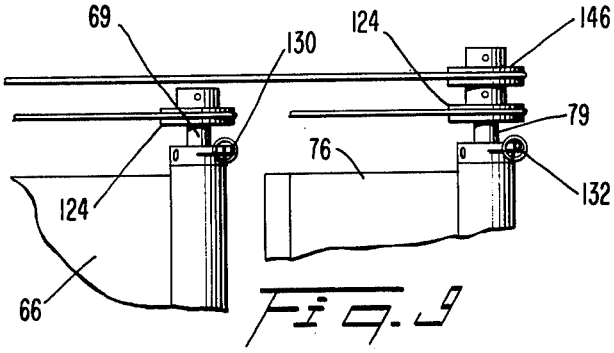
Fig. 9
Fig. 10
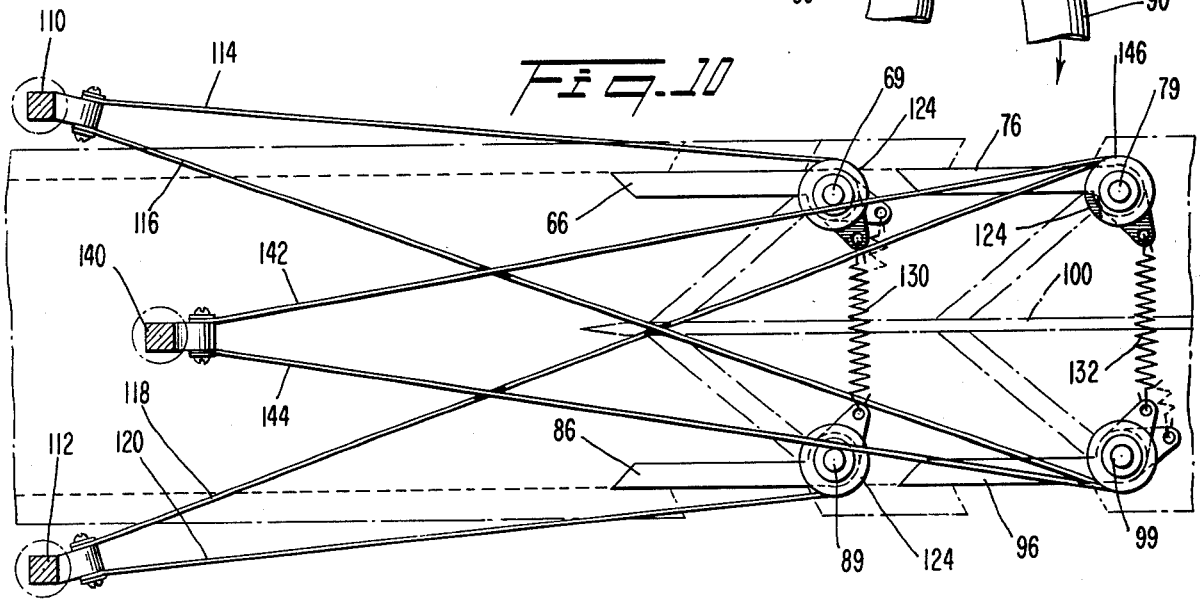

BOAT STEERING MECHANISM

BACKGROUND OF THE INVENTION

The present invention relates to small boats and, more particularly, to a propulsion and steering mechanism for a small, low powered boat.

Low powered boats have been heretofore proposed in which a central longitudinal channel is provided along the bottom of the boat. The channel is downwardly open at its fore and aft ends so as to be communicable with the water. A power driven propeller is positioned within the channel to propel water fore-to-aft through the channel and thereby advance the boat slowly through the water.

To steer boats of this general type it has been proposed to divert water flow to auxiliary channels which discharge at the side of the boat and thereby alter the course of travel of the boat. In this regard attention is directed to U.S. Sporri Pat. No. 3,610,197 issued Oct. 5, 1971, U.S. Egger Pat. No. 3,132,477 issued May 12, 1964, and U.S. Baggs Pat. No. 3,823,684 issued July 16, 1974, for disclosures of steering mechanisms operating generally in this fashion.

More particularly, it has been proposed in one instance to provide sidewardly extending passages which communicate at their inelt ends with the central channel and which open at opposite sides of the boat at their outlet ends. Longitudinally slidable gates are arranged at the passage inlets to open and close the passages. A separately actuable valve is mounted within the central channel downstream of the passage inlets and is swingable between open and closed positions. With the valve in a closed position, and with the communicate gates of only the portside passages open, water will be circulated through the portside passages to propel the boat sideways in a direction toward starboard. To propel the boat sideways in a direction toward port, the gates of only the starboard passages are opened. Besides requiring that separately actuable valve and gate members be actuated in order to divert the waterflow, such a steering arrangement does not enable the boat to be easily turned around.

Another proposal involves an annular array of valves which are actuated by a single upstanding lever. Associated with each valve is a passage through which water can be circulated, the passages being oriented to discharge water in different directions. The lever and valves are arranged such that when the lever is displaced in a particular direction one or more valves are actuated to eject water through one or more corresponding passages in order to propel the boat in the same direction in which the lever was displaced. Besides being complicated and costly, such a steering mechanism would apparently be able to turn the boat around only by a complicated procedure involving repeated actuations of the lever.

It will be appreciated that steering mechanisms of the above-described type are limited in their utility, being especially unable to quickly turn a boat around.

If a boat with such steering mechanisms were employed for fishing, for example, there would be no way to prevent fouling of a fishing line in instances where a hooked fish swims under the boat to the side opposite the fisherman's pole.

It is, therefore, an object of the present invention to minimize or obviate problems of this sort.

It is another object of the present invention to provide a novel steering mechanism for boats of the type earlier described.

It is a further object of the present invention to provide a novel boat steering mechanism which is of simplified and inexpensive construction and operation and which enables the boat to be quickly and easily turned.

BRIEF SUMMARY OF THE INVENTION

These objects are achieved by the present invention in which a boat comprises a hull having a seating compartment. A channel extends in a fore-to-aft longitudinal direction along a bottom of the hull. The channel includes a forwardly disposed water inlet and a rearwardly disposed water outlet. A motor driven propeller is disposed within the channel for circulating water from the water inlet rearwardly through the water outlet to propel the hull in a forward direction. Front and rear port passages include water entrance openings communicating with the channel downstream of the propeller, and water discharge openings directed laterally outwardly from the portside of the hull. Front and rear starboard passages include water entrance openings communicating with the channel downstream of the propeller, and water discharge openings directed laterally outwardly from the starboard side of the hull. A first pair of gates are actuable in unison for opening the entrance openings of the front port passage and the rear starboard passage while simultaneously blocking water flow to the channel outlet. In this fashion, water is discharged through the discharge openings of the front port and rear starboard passages to rotate the hull in a first direction. A second pair of gates are actuable in unison for opening the entrance openings of the front starboard passage and the rear port passage while simultaneously blocking water flow to the channel outlet. In this manner, water is discharged through the discharge openings of the front starboard passage and the rear port passage to rotate the hull in a second direction opposite the first direction.

THE DRAWING

The objects of the present invention will become apparent from the following detailed description of a preferred embodiment thereof in conjunction with the accompanying drawings wherein like elements designate numerals and wherein:

FIG. 4 is a rear view of the boat;

FIG. 5 is a close-up plan view of the flow channel of the boat taken in longitudinal section, depicting a condition in which the boat is being steered forwardly;

FIG. 6 is a view similar to FIG. 5, depicting a condition in which the boat is being turned counterclockwise;

FIG. 7 is a view similar to FIG. 5, depicting a condition in which the boat is being turned clockwise;

FIG. 8 is a view similar to FIG. 5, depicting a condition in which the boat is being steered in reverse;

FIG. 9 is a close-up side elevational view of a portion of the steering mechanism, viz. the connection between the control cables and the pulleys which drive the gates; and FIG. 10 is a plan view depicting the steering cable arrangement for the gates.

DETAILED DESCRIPTION OF A PREFERRED EMBODIMENT OF THE INVENTION

A preferred form of boat 10 in accordance with the present invention includes a hull 12 having opposed side portions 14 and a bottom portion 16 interconnecting lower ends of the side portions 14. The hull is of generally elliptical configuration when viewed in plan (FIG. 1) but could be of any desired shape.

Figure 3:
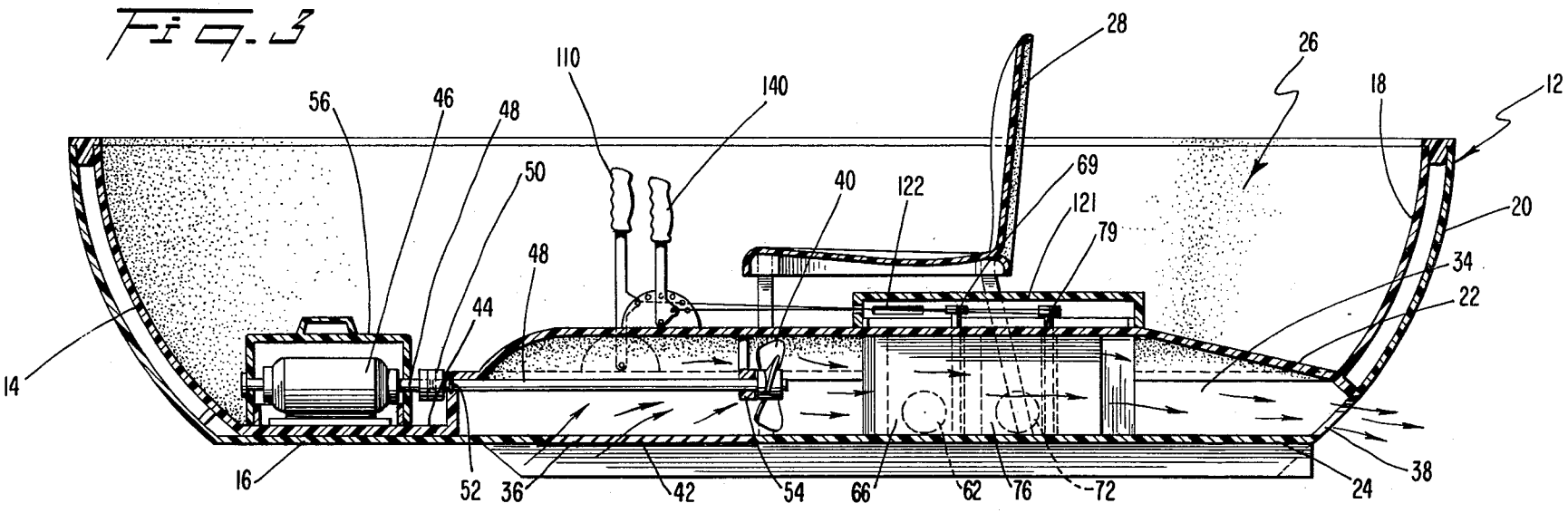
FIG. 3 is a longitudinal sectional view of the boat, taken along line 3—3 in FIG. 1, exposing the longitudinal flow channel.

The side and bottom portions 14, 16 of the hull 12 are preferably of double-wall construction and include inner and outer side walls 18, 20 and inner and outer bottom walls 22, 24 (FIG. 3). The inner side walls 18 and inner bottom wall 22 define the sides and floor of a seating compartment 26 within which can be disposed one or more seats 28.

Extending in a fore-to-aft longitudinal direction between the inner and outer bottom walls 22, 24 are a pair of upright walls 30, 32 defining a water channel 34 (FIG. 5). At its forward end the channel 34 includes a downwardly open water inlet 36 (FIG. 3), and at its rearward end includes a rearwardly open water outlet 38.

The portion of the inner bottom wall 22 disposed above the channel 34 is of somewhat arched configuration to enable the cross-sectional area of the channel 34 to be sufficiently large.

Situated within the channel 34 is a power driven propeller 40 which is able to circulate water from the channel inlet 36 rearwardly through the channel outlet 38, to propel the hull 12 forwardly. An apertured grating 42 may be positioned over the channel inlet 36 to filter-out objects of a size which might tend to damage or jam the propeller.

Sitting on a downwardly stepped section 44 of the bottom portion 16 of the hull 12 is a motor 46. The motor 46 can be of any suitable type but is preferably a low-power electrical motor having a drive shaft 48. The shaft is splined at 50 and passes into the channel 34 via a water tight bearing 52 and carries the propeller 40 at its rearward end. The shaft 48 can be journalled in a bearing 54 adjacent the propeller 40; or, in the alternative, the drive shaft 48 may be extended through and behind the propeller 40 to divider 100, and set in a cup bearing attached to divider 100 so that the drive shaft 48 may be easily pulled forward for purposes of repair assuming motor 46 has been removed. Operation of the motor 46 serves to rotate the propeller 40 to circulate water through the channel 34 and propel the boat. Rechargeable batteries (not shown) can be provided for driving the motor 46. The motor can be housed in a water-proof casing 56.

Communicating with the channel 34 intermediate its ends are a plurality of passages 60, 70, 80, 90 which are adapted to conduct water from the channel 34 and discharge that water from the sides of the hull 12 to vary the direction of travel of the boat viz., by rotating the boat clockwise or counterclockwise, or reversing the direction of advancement.

These passages comprise front and rear port passages 80, 90 and front and rear starboard passages 60, 70. Each passage includes a water entrance opening 62, 72, 82, 92 and a water discharge opening 64, 74, 84, 94. The inlet openings are formed in the walls 30, 32 of the channel 34 so as to communicate the channel with the passage at a location downstream of the propeller 40 (FIG. 5).

Each laterally-directed water discharge opening 64, 74, 84, 94 is directed laterally outwardly of the hull 12 from an appropriate one of the port or starboard sides.

Figure 1:
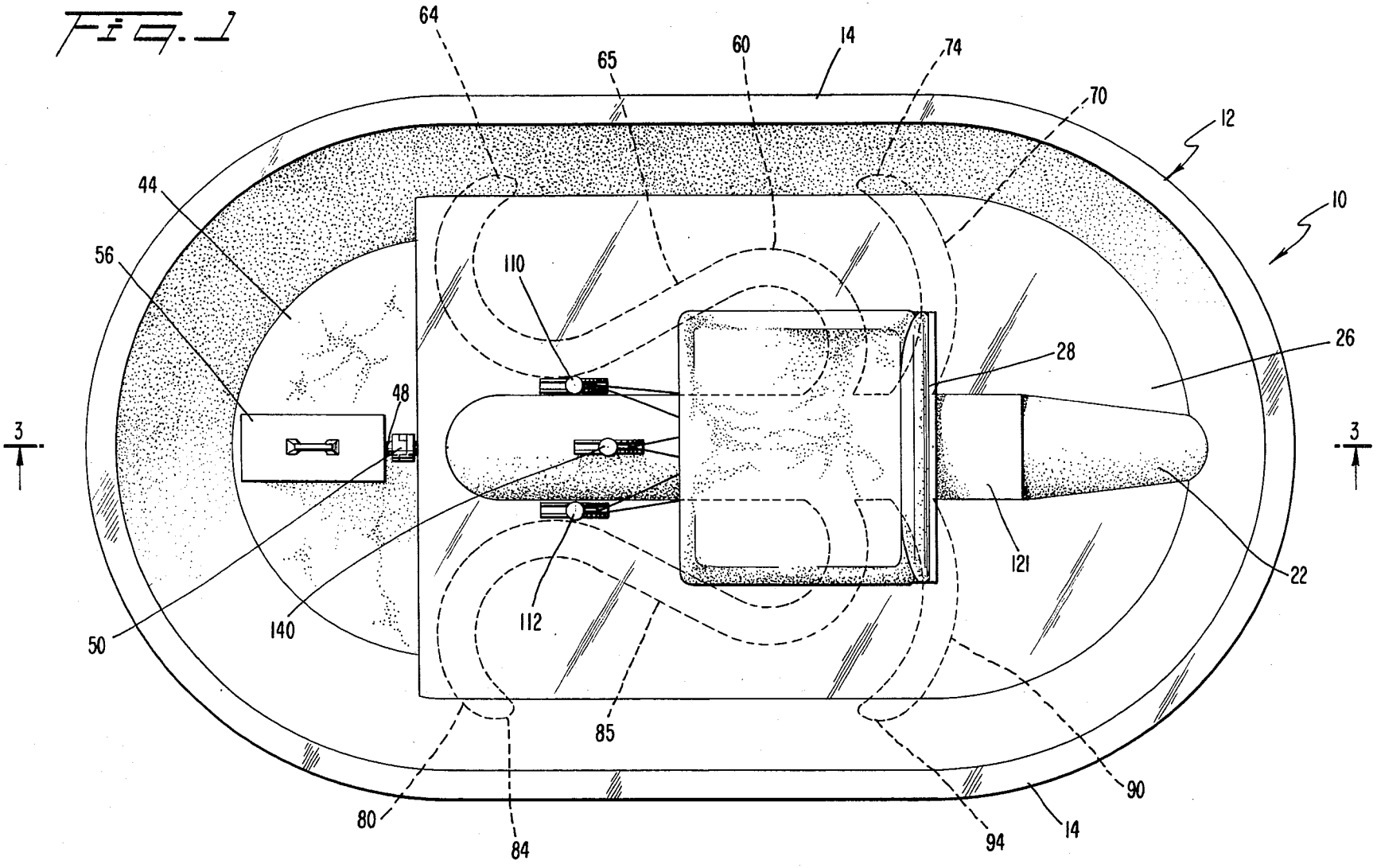
FIG. 1 is a plan view of a boat according to the present invention.
Figure 2:
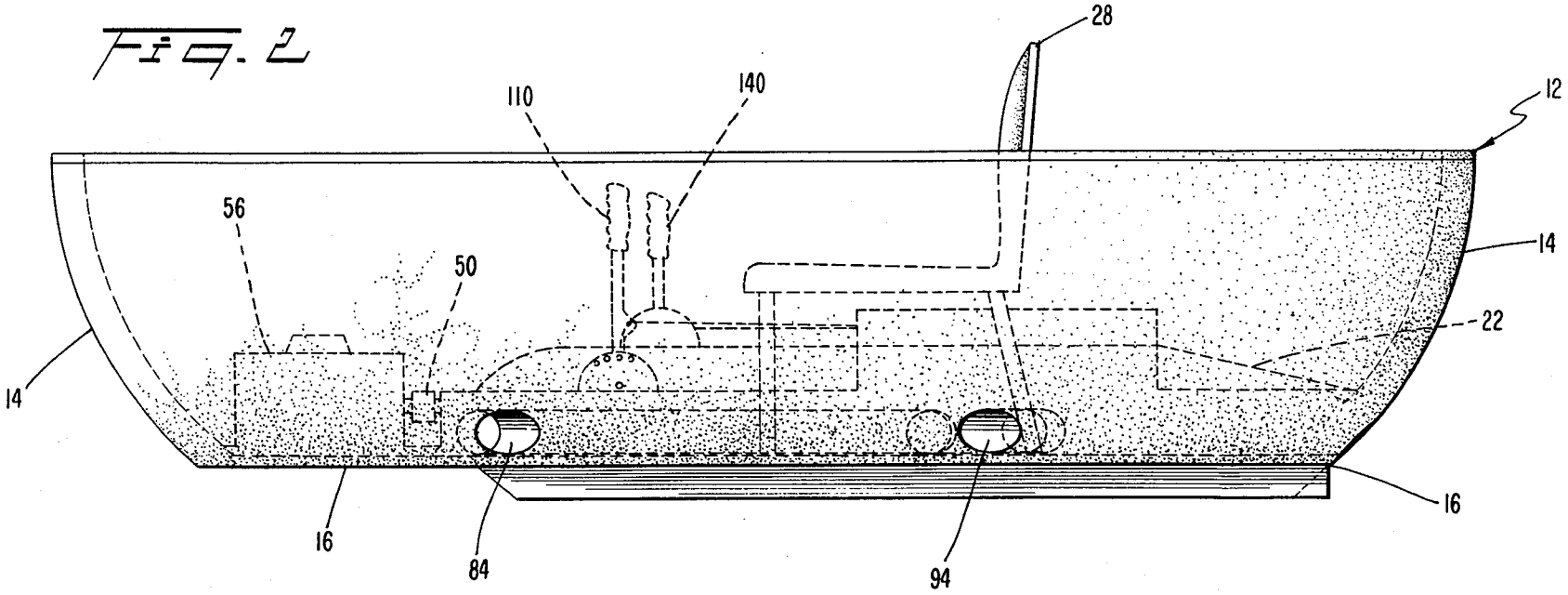
FIG. 2 is a side elevational view of the boat.

The water discharge openings 64, 84 of the front port and starboard passages 60, 80 are located forwardly of a plane extending transversely through the center of the hull, and the water discharge openings 74, 94 of the rear port and starboard passages 70, 90 are located rearwardly of such plane. Since the inlet openings 62, 72, 82, 92 of the passages are preferably located rearwardly of such plane, the front port and starboard passages 60, 80 are somewhat longer than the other two passages 70, 90 and include generally fore-to-aft extending sections 65, 85 (FIG. 1).

The discharge opening 84 of the front port passage 80 is directed slightly rearwardly, and the diagonally opposite discharge opening 74 of the rear starboard passage 70 is directed slightly forwardly, the directions of these two discharge opening 84, 74 being preferably parallel. The discharge openings of the front starboard and rear port passages 64, 94 are similarly arranged.

Mounted at each passage entrance opening 62, 72, 82, 92 is a water control gate 66, 76, 86, 96 (FIG. 5). Each gate is swingably mounted at its rearward end to a channel side wall by a pivot mounting. Each pivot mounting includes an upright axle 69, 79, 89, 99 connected to an associated gate, 66, 76, 86, 96 and mounted in suitable bearings (not shown). Rotation of these axles, by means to be discussed, serves to swing the gates toward open and closed positions.

Mounted within the center of the channel 34 is an upright, longitudinally extending divider wall 100 (FIG. 5) which separates the channel 34 into a pair of port and starboard channel portions 34P, 34S in the vicinity of the gates 66, 76, 86, 96.

A gate actuating mechanism is operably connected to the gates so as to be able to swing open the front port and rear starboard gates 86, 76 in unison, and for swinging open the front starboard and rear port gates 66, 96 in unison. As a gate swings open, its forward free end abuts against the divider wall 100 to divert all water flow in the associated channel portion 34S, 34P through the passage associated with that gate.

Thus, by swinging open the front port and rear starboard gates 76, 86 (FIG. 7), water flow to the channel outlet 38 is completely blocked and the water being circulated is diverted and caused to be discharged through the front port and rear starboard discharge openings 84, 74. In this fashion, the hull 12 is caused to rotate in a clockwise fashion when viewed in plan essentially about its own central vertical axis.

When the other set of gates, i.e., front starboard and rear port gates 66, 96 are swung open (FIG. 6), all of the water is diverted to the front starboard and rear port passages 60, 90 and the hull 12 is rotated counterclockwise when viewed in plan.

It will be appreciated, then, that by merely opening two gates, all of the propulsion energy is expended in turning the boat in rapid fashion about its own vertical axis.

One advantage of such maneuverability will be apparent to a fisherman who at one time or another has had his line fouled by a hooked fish which swam beneath the boat to the other side, i.e., the side opposite the fishing pole. If the fisherman were utilizing the present invention, he could quickly and easily rotate the boat to unfoul the line and follow the fish.

Actuation of the gates 66, 76, 86, 96 can be effected by any suitable mechanism, many possibilities being readily apparent to those skilled in the art.

Preferably, a lever-cable system (FIGS. 9–10) is provided which includes a pair of upstanding levers 110, 112 which are each pivotably mounted at their lower ends adjacent the bottom of the seating compartment. Each lever 110, 112 has a pair of cables 114, 116 and 118, 120 anchored thereto above the pivot mounting. The cables of each lever pass through a slot 122 (FIG. 3) in a cover wall 121 mounted atop the wall 22 and are operably connected to one set of gates 66, 96 or 76, 86. In this regard, the hinge axles 69, 79, 89, 99 of the gates extend upwardly through the inner bottom wall 22, via water-tight bearings, and each carry a pulley 124 which is fixed on the axle for rotation therewith. Each of the pulleys 124 receives an end of a cable 114, 116, 118 or 120 which is wrapped therearound, so that forward displacement of the associated lever 110 or 112 produces rotation of the axles of an associated set of gates 66, 96 (FIG. 6) or 76, 86 (FIG. 7), causing the gates to be swung open against the wall 100.

More particularly, the cables 114, 116 from the lever 100 are connected to the pulley 124 of the front starboard gate 66 and to the pulley 124 of the rear port gate 96, respectively. The cables 118, 120 from the other lever 112 are connected to the pulleys 124 of the front port gate 86 and to the pulley 124 of the rear starboard gate 76. By pushing the lever 110 forwardly the boat turns counterclockwise, and by pushing the lever 112 forwardly the boat turns clockwise.

The gates are preferably spring biased to a passage-closing position (FIG. 5), so that upon release of the levers 110, 112 the gates automatically swing shut. Preferably, a first coil tension spring 130 is connected between the front pulleys, and a second coil tension spring 132 is connected between the rear pulleys (FIG. 10) in such manner that a spring is tensioned whenever forward movement of a lever causes the associated gates to be rotated from a closed position. When the lever is released, the spring rotates the hinge axles of these gates in the reverse direction so as to return the gates to a passage-closing position. Or the hand levers 110, 112 may be stationed with additional pulleys to move from side to side instead of forward.

Of course, other types of gate actuating mechanisms can be employed. For instance, foot pedals could be provided in lieu of hand levers. Alternatively, motorized gates could be employed.

It may also be desirable to provide a mechanism for propelling the boat in reverse. This type of motion is facilitated by the fact that the rear port and starboard passage discharge openings 94, 74 are oriented slightly forwardly. By opening the gates 76, 96 associated with these passages (FIG. 8), water is discharged in a direction having a forward directional component, and thus the boat will travel in reverse.

To accomplish this maneuver, a third hand lever 140 is provided which has two cables 142, 144 (FIG. 10) connected to auxiliary pulleys 146 on the hinge axles 79, 99 of the rear gates (FIG. 9). By pushing the reverse lever 140 forwardly, both of the rear gates 76, 96 are swung open, thereby diverting the circulated water through the rear discharge openings to propel the boat in reverse.

OPERATION

In operation, the boat 10 is driven forwardly by the motor-driven propeller 40, with the gates in their closed positions (FIG. 5). The propeller 40 establishes a flow of water from the opening 36 in the channel 34 and through the outlet 38. In the event that it is desired to turn the boat, such as in the event that a fisherman hooks a fish which carries the line beneath the boat, an appropriate one of the turn levers 110, 112 is actuated. For example, if clockwise rotation is desired, the lever 112 is displaced forwardly by the arm, knee, or foot, etc. of the occupant. The cables 118, 120 associated with the lever 112 rotate the gates 86, 76 of the front port passage 80 and the rear starboard passage 70. Accordingly, all of the water drawn into the channel 34 is diverted equally through the discharge openings 84, 74 of the front port passage 80 and the rear starboard passage 70. As a result, the boat rotates clockwise (as viewed in plan) essentially about its own central vertical axis.

To turn the boat counterclockwise, the other lever 110 is displaced forwardly to open the gates 66, 96 of the front starboard and rear port passages 60, 90.

When the lever 110 or 112 is released, the gates are swung shut by the springs 130, 132, thereby causing the cables to be rewound on the associated pulleys and the lever to be returned to an at-rest position.

If it is desired to propel the boat rearwardly, the reverse lever 140 is displaced forwardly to swing open the rear gates 76, 96. Water is thus discharged through the slightly forwardly directed discharge openings 74, 94 of the rear passages 70, 90 to propel the boat in reverse.

BRIEF SUMMARY OF MAJOR ADVANTAGES AND SCOPE OF THE INVENTION

In accordance with the present invention a simplified and inexpensive propulsion/steering mechanism is provided which provides for rapid turning of a boat about a minimum radius. Such maneuvering is highly advantageous whether the boat is being used for pleasure or for fishing. In the latter event, it is possible to prevent fishing lines from being fouled and for a hooked fish to be effectively followed.

Moreover, flow of water to the outlet of the channel is blocked by the passage-opening gates themselves so that no separate channel closing device need be actuated. This also assures that full power will be employed in turning the boat.

Although the invention has been described in connection with a preferred embodiment thereof, it will be appreciated by those skilled in the art that additions, modifications, substitutions and deletions not specifically described may be made without departing from the spirit and scope of the invention as defined in the appended claims.

What is claimed is:

1. A boat comprising:

a hull including a seating compartment, a channel extending in a fore-to-aft longitudinal direction along a bottom of said hull, said channel at its fore end including a water inlet, and at its aft end a water outlet, a motor driven propeller disposed within said channel for circulating water from said water inlet rearwardly through said water outlet to propel said hull in a forward direction, front and rear port passages including water entrance openings communicating with said channel downstream of said propeller and water discharge openings directed laterally outwardly from the portside of said hull, said water discharge opening of said front port passage being disposed forwardly of said water discharge opening of said rear port passage;

front and rear starboard passages including water entrance openings communicating with said channel downstream of said propeller and water discharge openings directed laterally outwardly from the starboardside of said hull, said water discharge opening of said front starboard passage being disposed forwardly of said water discharge opening of said rear starboard passage;

a first pair of gates actuable in unison for opening said entrance openings of said front port passage and said rear starboard passage while simultaneously blocking water flow to said channel outlet, so that water is discharged through said discharge openings of said front port passage and said rear starboard passage to rotate said hull in a first direction, and a second pair of gates actuable in unison for opening said entrance openings of said front starboard passage and said rear port passage while simultaneously blocking water flow to said channel outlet, so that water is discharged through said discharge openings of said front starboard passage and said rear port passage to rotate said hull in a second direction opposite said first direction.

2. A boat according to claim 1, including a longitudinally extending wall situated centrally in said channel opposite said entrance openings, said gates each including a rear end swingably mounted about a vertical pivot axis so as to be swingable between a position closing said entrance opening and another position wherein a forward free end thereof abuts said wall to divert water flow into an associated passage.

3. A boat according to claim 2, including manual actuating means accessible from said seating compartment, first means connecting said actuating means with said first pair of gates and second connecting means connecting said actuating means with said second pair of gates.

4. A boat according to claim 3, including spring means operably connected to said gates to bias said gates closed.

5. A boat according to claim 4, wherein said discharge openings of said rear passages are directed slightly forwardly; additional actuating means connected to said rear gates for opening said rear gates to discharge water through said discharge openings of said rear passages and propel said hull rearwardly.

* * * * *